US012140154B2

(12) United States Patent
Matsubara

(10) Patent No.: US 12,140,154 B2
(45) Date of Patent: Nov. 12, 2024

(54) ELECTRIC SUBMERSIBLE PUMP

(71) Applicant: TSURUMI MANUFACTURING CO., LTD., Osaka (JP)

(72) Inventor: Oki Matsubara, Kyoto (JP)

(73) Assignee: Tsurumi Manufacturing Co., Ltd., Osaka (JP)

( * ) Notice: Subject to any disclaimer, the term of this patent is extended or adjusted under 35 U.S.C. 154(b) by 0 days.

(21) Appl. No.: 18/278,307

(22) PCT Filed: Sep. 13, 2022

(86) PCT No.: PCT/JP2022/034287
§ 371 (c)(1),
(2) Date: Mar. 22, 2024

(87) PCT Pub. No.: WO2024/057419
PCT Pub. Date: Mar. 21, 2024

(65) Prior Publication Data

US 2024/0263643 A1 Aug. 8, 2024

(51) Int. Cl.
*F04D 29/42* (2006.01)
*F04D 13/08* (2006.01)
*F04D 29/22* (2006.01)

(52) U.S. Cl.
CPC ..... *F04D 29/4293* (2013.01); *F04D 13/08* (2013.01); *F04D 29/22* (2013.01); *F04D 29/4273* (2013.01)

(58) Field of Classification Search
CPC ..... F04D 13/086; F04D 17/10; F04D 29/225; F04D 29/284; F04D 29/4213; F04D 29/426; F04D 29/445; F04D 29/462; F04D 7/04; F04D 9/002; F04D 29/4293; F04D 13/08; F04D 29/22
See application file for complete search history.

(56) References Cited

U.S. PATENT DOCUMENTS

| | | | | |
|---|---|---|---|---|
| 5,769,603 | A * | 6/1998 | Fujiwara | F04D 9/002 415/206 |
| 2018/0080470 | A1* | 3/2018 | Koga | F04D 29/4213 |
| 2023/0258188 | A1* | 8/2023 | Okuno | F04D 29/4273 415/121.1 |

FOREIGN PATENT DOCUMENTS

| | | | | |
|---|---|---|---|---|
| CN | 212028163 | U | | 11/2020 |
| CN | 212690371 | U | * | 3/2021 |
| GB | 911016 | A | | 11/1962 |
| JP | H07286595 | A | | 10/1995 |
| JP | H0932791 | A | | 2/1997 |
| JP | H1193881 | A | | 4/1999 |
| JP | 2005240764 | A | * | 9/2005 |
| JP | 2006291937 | A | | 10/2006 |
| JP | 2008169737 | A | * | 7/2008 |
| JP | 2014034885 | A | | 2/2014 |

(Continued)

OTHER PUBLICATIONS

Search report in corresponding EP application 22926357.9 dated May 3, 2024 (pp. 1-9).

*Primary Examiner* — Dominick L Plakkoottam
(74) *Attorney, Agent, or Firm* — Millen, White, Zelano & Branigan P.C.; William F. Nixon

(57) ABSTRACT

An electric submersible pump (100) includes a casing (11) and a closed impeller (4), and the casing includes a suction flow-path portion (14) that faces the closed impeller, has a suction port protruding in a convex shape and is formed integrally with the casing.

8 Claims, 8 Drawing Sheets

(56) References Cited

FOREIGN PATENT DOCUMENTS

| | | | | |
|---|---|---|---|---|
| JP | 2015038356 | A | * | 2/2015 |
| JP | 2017115593 | A | | 6/2017 |
| JP | 2019120224 | A | * | 7/2019 |
| JP | 2019183807 | A | * | 10/2019 |
| JP | 2020172876 | A | | 10/2020 |

* cited by examiner

ELECTRIC SUBMERSIBLE PUMP

TECHNICAL FIELD

The present invention relates to an electric submersible pump, and particularly to an electric submersible pump including a closed impeller.

BACKGROUND ART

Conventionally, an electric submersible pump including a closed impeller, which has a vane portion covered by main and side plates in contrast with an open impeller having an uncovered vane portion, is known. Such an electric submersible pump is disclosed in Japanese Patent Laid-Open Publication No. JP 2006-291937, for example.

Japanese Patent Laid-Open Publication No. JP 2006-291937 discloses a pump including an electric motor, a drive shaft, a closed impeller and a pump casing. In Patent Document 1, suction portions of the closed impeller and the pump casing are configured to communicate with each other. Also, the closed impeller is mounted to the drive shaft.

PRIOR ART

Patent Document

Patent Document 1: Japanese Patent Laid-Open Publication No. JP 2006-291937

SUMMARY OF THE INVENTION

Problems to be Solved by the Invention

Although not disclosed in Japanese Patent Laid-Open Publication No. JP 2006-291937, a sealing portion that prevents leakage of liquid in the casing (e.g., drawn water) to the electric motor side is attached onto a main shaft on the electric motor side of the casing. Also, in order to minimize the rate of liquid that laterally flows through a gap between a suction port and the closed impeller so as to prevent efficiency reduction of the electric submersible pump, a bottom end of the closed impeller is positioned in the vicinity of the suction port.

Although not disclosed in Japanese Patent Laid-Open Publication No. JP 2006-291937, it can be considered that the flow rate is increased to improve the performance of the electric submersible pump. In order to increase the depth of the casing so as to increase the flow rate, if the gap between the closed impeller and the suction port of the casing is increased, the rate of liquid laterally flowing through the gap between the suction port and the closed impeller will be increased, and correspondingly it can be considered that a vane width, which is a height in an extension direction of the main shaft of the closed impeller, is increased. However, because such an increase of the vane width lowers the center of gravity of the closed impeller, and the increased rate of liquid increases a radial force acting on the center of gravity of the closed impeller, the closed impeller may be eccentric. Consequently, there is a problem that the main shaft may be distorted, and the distortion of the main shaft may create a gap between the main shaft and the sealing portion and cause entry of liquid into the electric motor side.

The present invention is intended to solve the above problems, and one object of the present invention is to provide an electric submersible pump capable of increasing the flow rate while reducing entry of liquid to its electric motor side.

Means for Solving the Problems

In order to attain the aforementioned object, an electric submersible pump according to an aspect of the present invention includes a casing including a flow path having a spiral shape, and a suction port for drawing liquid into the flow path; a closed impeller including a vane portion, a main plate holding the vane portion, and a side plate opened on the suction port side of the casing; an electric motor including a main shaft connected to the closed impeller, wherein the casing includes a suction flow-path portion that faces the closed impeller, has the suction port protruding in a convex shape and is formed integrally with the casing.

In the electric submersible pump according to this aspect of the present invention, as described above, the casing includes a suction flow-path portion that faces the closed impeller, has the suction port protruding in a convex shape and is formed integrally with the casing. Accordingly, even if the depth of the casing is increased in order to increase the flow rate, the gap between the closed impeller and the suction port can be kept small by adjusting a protrusion height of the suction flow-path portion. Consequently, the gap between the closed impeller and the suction port can be kept small so that a flow rate of liquid that laterally flows through the gap between the suction port and the closed impeller can be minimized while increasing the depth of the casing whereby increasing the flow rate. Also, the size of the gap between the closed impeller and the suction port can be adjusted by the protrusion height of the suction flow-path portion, and thus the vane width can be small. Consequently, the vane width can be small, and thus entry of liquid to the electric motor side that is caused by shaft distortion can be reduced. Therefore, the flow rate can be increased while reducing entry of liquid to the electric motor side.

In the aforementioned electric submersible pump according to this aspect, a vane width, which is a height of the closed impeller including the vane portion and the main and side plates in an extension direction of the main shaft, is preferably smaller by a protrusion height of the suction flow-path portion in the extension direction of the main shaft than a maximum depth of the flow path of the casing in the extension direction of the main shaft. According to this configuration, the vane width of the closed impeller can be reduced by the protrusion height of the suction flow-path portion, and thus the vane width can be easily reduced. As a result, distortion of the main shaft caused by a vane width increase can be reduced, and therefore entry of liquid to the electric motor side can be easily prevented.

In the aforementioned electric submersible pump according to this aspect, the suction flow-path portion preferably has a cylindrical shape extending from the suction port side toward the closed impeller side. According to this configuration, liquid can be drawn through the cylindrical inside flow path of the suction flow-path portion.

In this case, it is preferable that the side plate of the closed impeller has an opening opened on the suction flow-path portion side, and that an inside diameter of the opening is substantially the same as an inside diameter of the suction flow-path portion on an end of the closed impeller side as viewed in the extension direction of the main shaft. According to this configuration, a flow path that connects the suction flow-path portion to the closed impeller can have substantially a constant diameter, and thus the closed impeller can efficiently draw liquid that passes through the suction flow-path portion.

In the aforementioned electric submersible pump according to this aspect, it is preferable that the casing and the suction flow-path portion are integrally formed of a resin. According to this configuration, the casing having the suction flow-path portion can be easily formed.

In this case, it is preferable that the side plate of the closed impeller has an opening opened on the suction flow-path portion side, and that the opening and the suction flow-path portion are spaced at an interval not greater than 5 mm from each other in the extension direction of the main shaft. According to this configuration, a flow rate of liquid that laterally flows through the gap between the opening and the suction flow-path portion can be minimized, and thus it is possible to prevent efficiency reduction of the electric submersible pump.

In the aforementioned electric submersible pump according to this aspect, the protrusion height of the suction flow-path portion in the extension direction of the main shaft is preferably not smaller than 20% of the maximum depth of the flow path in the extension direction of the main shaft. According to this configuration, it is possible to produce an electric submersible pump having a sufficient flow rate while preventing an increase of the vane width of the closed impeller. This effect is confirmed by the later-discussed experiment (examples).

In the aforementioned electric submersible pump according to this aspect, the casing preferably includes an exhaust port for exhausting air in the casing, a sealing member arranged below the exhaust port and configured to be pushed upward by the liquid so as to seal the exhaust port when the liquid is drawn, and a base portion configured to receive the sealing member and to form an upward flow of the liquid for pushing the sealing member upward toward the exhaust port. According to this configuration, the base portion is positioned in the vicinity below the center of gravity of the sealing member so that the sealing member can be stably pushed upward, and thus the sealing member can be reliably pushed to the position of the exhaust port whereby reliably sealing the exhaust port.

In this case, it is preferable that the base portion has a generally V shape. According to this configuration, inclined parts, which form the V shape, can collect liquid, and thus an upward force for pushing the sealing member can be increased.

Effect of the Invention

According to the present invention, as described above, an electric submersible pump capable of increasing the flow rate while reducing entry of liquid to its electric motor side can be provided.

MODES FOR CARRYING OUT THE INVENTION

One embodiment according to the present invention is hereinafter described on the basis of the drawings.

Embodiment (Configuration of Electric Submersible Pump)

An electric submersible pump 100 according to the embodiment is described with reference to FIGS. 1 to 7. The electric submersible pump 100 is a vertical electric submersible pump having a main shaft 33 whose rotation center axis a extends in an upward/downward direction (Z-direction). The electric submersible pump 100 will be arranged under water when used.

Figure 1:
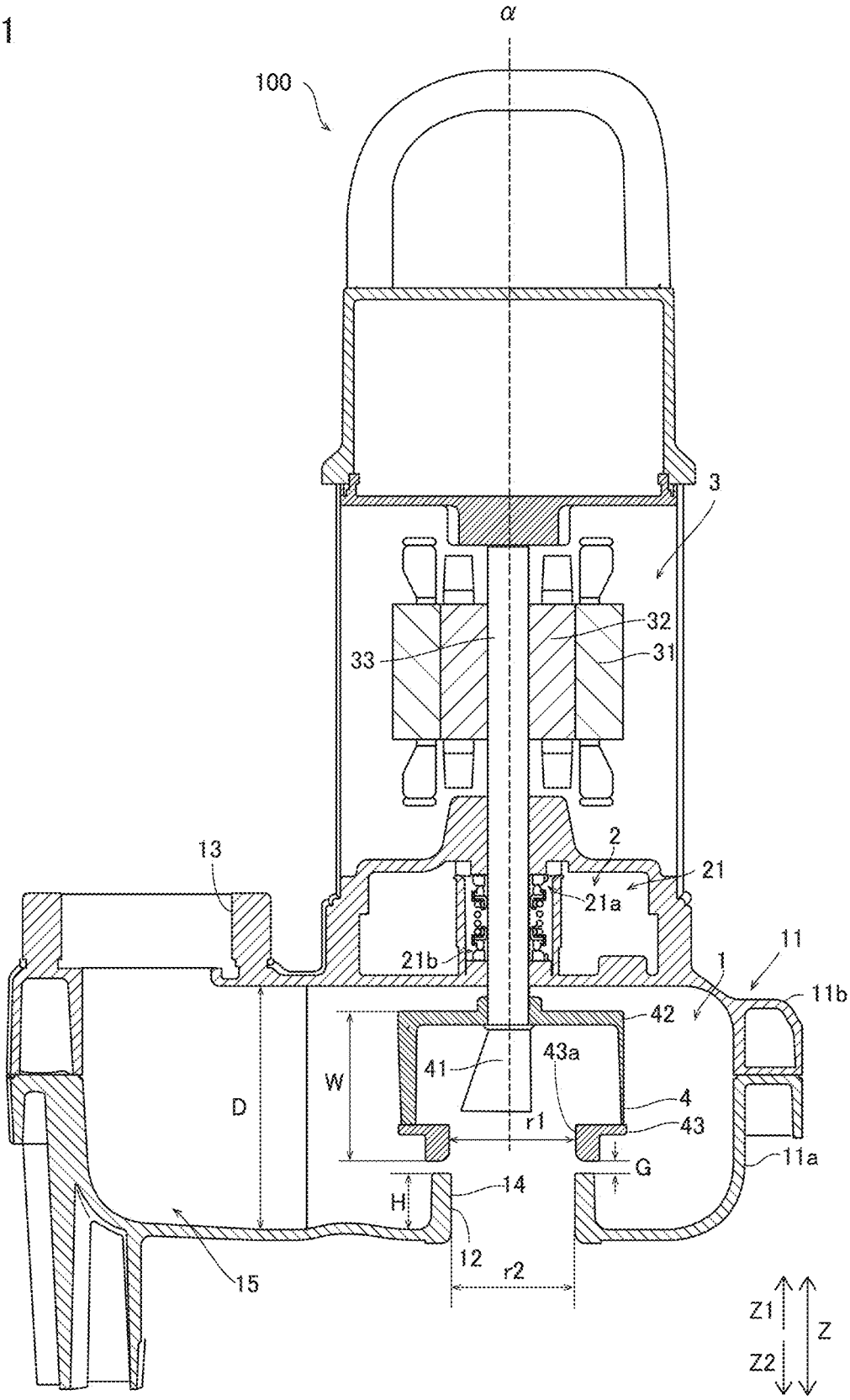
FIG. 1 is a schematic diagram showing the overall configuration of an electric submersible pump according to an embodiment.

As shown in FIG. 1, the electric submersible pump 100 includes a pump chamber 1, an oil chamber 2 and an electric motor 3. An extension direction of the rotation center axis a of the main shaft 33 is shown by the Z-direction, and one of the Z-directions from a closed impeller 4 side toward the electric motor 3 side is defined as a Z1 direction while the direction opposite to the Z1 direction is defined as a Z2 direction.

The pump chamber 1 is enclosed by a casing 11. The casing 11 includes lower and upper casings 11*a* and 11*b* located on the Z2 and Z1 sides, respectively. The casing 11 is formed of a resin. The lower and upper casings 11*a* and 11*b* are separately produced, and the casing 11 is formed by joining the lower and upper casings 11*a* and 11*b* to each other.

The casing 11 has a suction port 12, a discharge port 13, a suction flow-path portion 14 and a flow path 15.

The suction port 12 is arranged on the lower side (Z2 side) of the lower casing 11*a*. When the closed impeller 4 is rotated, liquid (e.g., drawn water) flows through the suction port 12 in the Z1 direction into the pump chamber 1.

The discharge port 13 is arranged on the upper side (Z1 side) of the upper casing 11*b*. Liquid in the pump chamber 1 is discharged through the discharge port 13 by a centrifugal force that is produced by rotation of the closed impeller 4.

The suction flow-path portion 14 is formed inside the lower casing 11*a*. The suction flow-path portion 14 protrudes in the Z1 direction in a convex shape from the periphery of the suction port 12 toward the closed impeller 4. The suction flow-path portion 14 faces the closed impeller 4 in the main shaft 33 extension direction (Z-direction). The suction flow-path portion 14 is formed of the resin integrally with the lower casing 11*a*.

Figure 2:
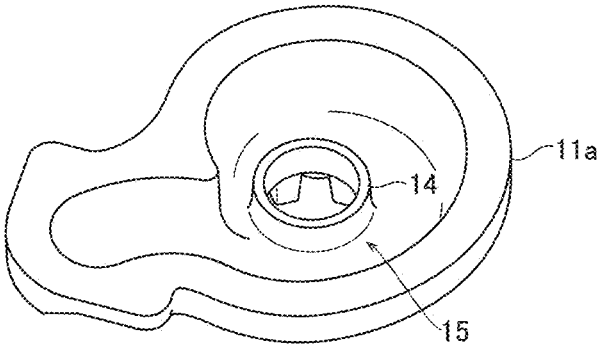
FIG. 2 is a perspective diagram showing a lower casing of the electric submersible pump according to the embodiment.

As shown in FIGS. 1 and 2, the suction flow-path portion 14 has a cylindrical shape extending in the Z-direction from the suction port 12 side toward the closed impeller 4 side.

The suction flow-path portion 14 has a protrusion height H in the main shaft 33 extension direction (Z-direction) not smaller than 15%, preferably not smaller than 20%, and more preferably not smaller than 25% of a maximum depth D of the flow path 15 in the main shaft 33 extension direction. The protrusion height H refers to a height from the interior bottom surface of the casing 11.

As shown in FIGS. 1 and 2, the flow path 15 is formed inside the lower casing 11*a*. The flow path 15 has a spiral shape (volute shape) as viewed in the Z-direction. The flow path 15 has a flow width becoming greater from the suction port 12 toward the discharge port 13. The maximum depth D of the flow path 15 in the main shaft 33 extension direction (Z-direction) is greater by the protrusion height H of the suction flow-path portion 14 in the main shaft 33 extension direction than a vane width W as the size of the closed impeller 4, which includes vane portions 41 and main and side plates 42 and 43, in the main shaft 33 extension direction. The suction port 12 and the flow path 15 communicate with each other through the suction flow-path portion 14.

Figure 3:
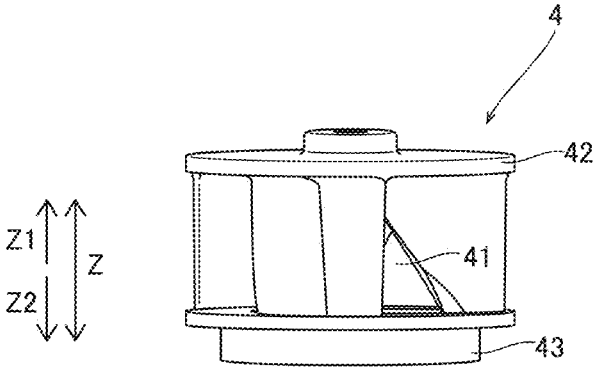
FIG. 3 is a diagram showing a closed impeller of the electric submersible pump according to the embodiment as viewed from a lateral side.

As shown in FIGS. 1 and 3, the closed impeller 4 includes the vane portions 41, and the main and side plates 42 and 43. The closed impeller 4 is housed in the flow path 15. The vane width W as a height of the closed impeller 4, which includes the vane portions 41 and the main and side plates 42 and 43, in the main shaft 33 extension direction (Z-direction) is smaller by the protrusion height H in the main shaft extension direction (Z-direction) of the suction flow-path portion 14 than the maximum depth D of the flow path 15 of the casing 11 in the main shaft 33 extension direction (Z-direction). The vane width W of the closed impeller 4 is not greater than 80%, preferably not greater than 75% of the maximum depth D of the flow path 15.

The vane portions 41 are mounted to a Z2-side end of the main shaft 33. The vane portions 41 stir liquid so as to produce the centrifugal force when rotated.

The main plate 42 covers electric motor 3 sides of the vane portions 41. The main plate 42 holds the vane portions 41. The main plate 42 has a disk shape.

The side plate 43 is arranged on a suction port 12 side of the casing 11. The main and side plates 42 and 43 are spaced away from each other in the Z-direction so as to interpose the vane portions 41 between them. The side plate 43 has an opening 43*a* opened toward the suction flow-path portion 14 side. The side plate 43 has a disk shape.

Figure 4:
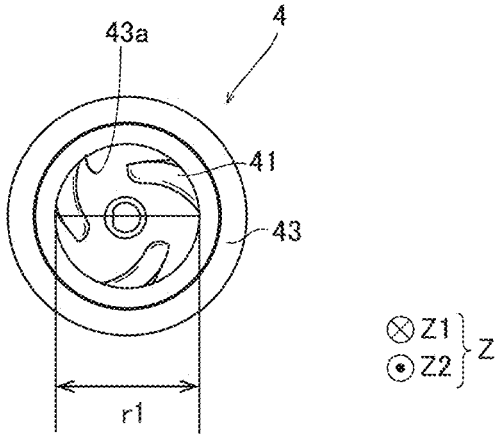
FIG. 4 is a diagram showing the closed impeller of the electric submersible pump according to the embodiment as viewed from a suction flow-path portion side.
Figure 5:
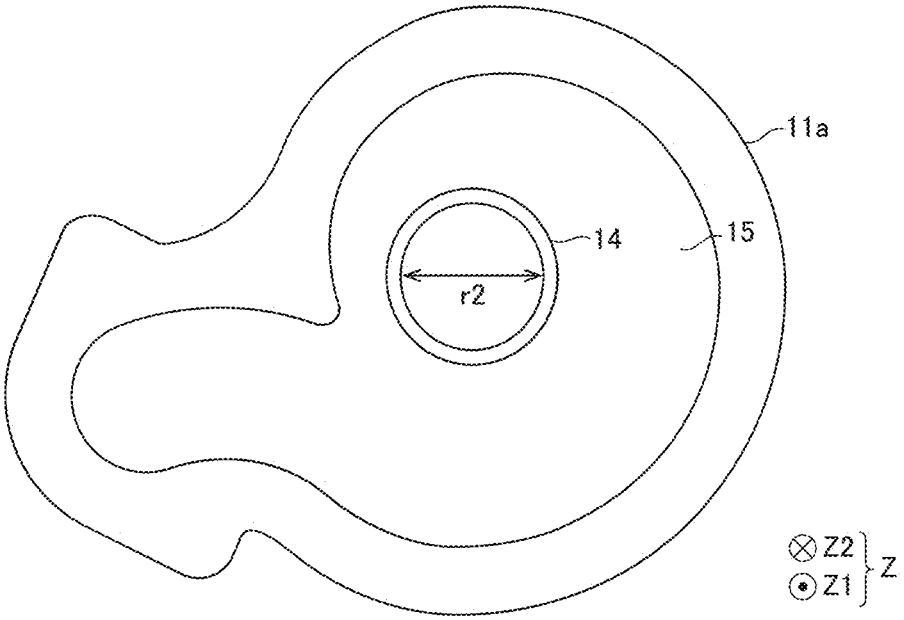
FIG. 5 is a diagram showing a casing according to the embodiment as viewed from the closed impeller side.

As shown in FIGS. 4 and 5, an inside diameter r1 of the opening 43*a* is substantially the same as an inside diameter r2 of an end of the suction flow-path portion 14 on the closed impeller 4 side (Z1 side) as viewed from the suction flow-path portion 14 side.

As shown in FIG. 1, the opening 43*a* and the suction flow-path portion 14 are spaced away at a gap G in the main shaft 33 extension direction. The gap G is dimensioned depending on places where the electric submersible pump 100 is used. The gap G can be not greater than 5 mm, preferably greater than 1 mm and not greater than 5 mm, more preferably not greater than 3 mm.

As shown in FIG. 1, the electric motor 3 includes a stator 31, a rotator 32 and the main shaft 33. The electric motor 3 is arranged on the Z1 side relative to the closed impeller 4. The main shaft 33 is connected to the closed impeller 4.

The oil chamber 2 is located between the electric motor 3 and the pump chamber 1. A mechanical seal 21 is arranged in the oil chamber 2 to prevent entry of liquid inside the pump chamber 1 into the oil chamber 2. The mechanical seal 21 surrounds the main shaft 33.

The mechanical seal 21 includes sliding portions 21*a* and 21*b* configured to slide in rotation of the main shaft 33. The sliding portion 21*a* is arranged on an electric motor 3 side (Z1 side) of the oil chamber 2 to prevent entry of oil inside the oil chamber 2 to the electric motor 3 side. Also, the sliding portion 21*b* is arranged on a pump chamber 1 side (Z2 side) of the oil chamber 2 to prevent entry of liquid in the pump chamber 1 into the oil chamber 2.

Figure 6:
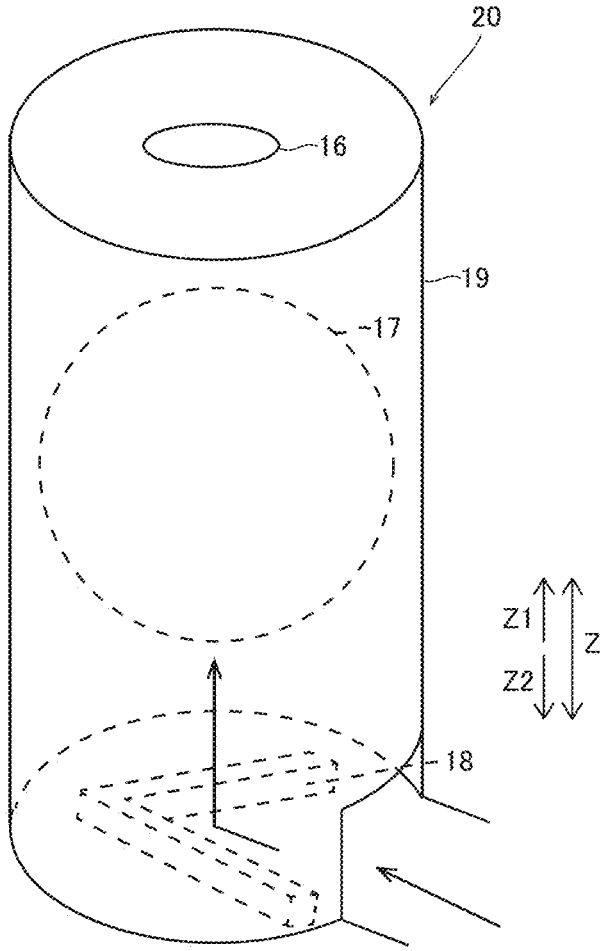
FIG. 6 is a diagram showing the configuration of an exhaust portion.
Figure 7:
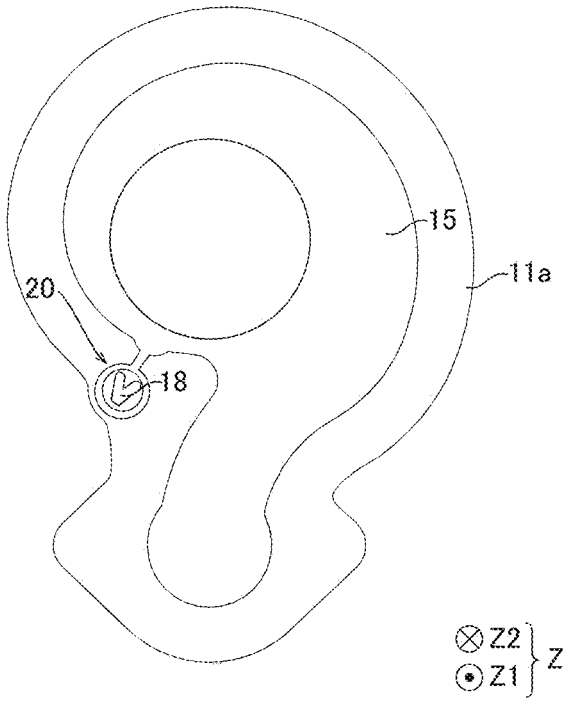
FIG. 7 is a diagram showing the position at which the exhaust portion is provided.

As shown in FIGS. 6 and 7, the casing 11 includes an exhaust portion 20 configured to exhaust air in the casing 11 to the outside. The exhaust portion 20 is constructed of an exhaust port 16, a sealing member 17, a base portion 18 and an exhaust tube 19. When the electric submersible pump 100 operates, the exhaust port 16 is sealed by the sealing member 17 pushed upward by liquid so that air will not be exhausted from the exhaust portion 20. Because the vane width W is dimensioned smaller in the electric submersible pump 100 according to the present invention, a force of liquid that pushes the sealing member 17 upward will be small, and as a result the sealing member 17 may not sufficiently provide its sealing function in the operation of the electric submersible pump 100. To address this, the base portion 18 is provided to increase the pushing force of liquid, which pushes the sealing member 17 upward. Arrows in FIG. 6 show a flow of liquid when the sealing member 17 will seal the exhaust port 16. The exhaust portion 20 communicates with the lower casing 11*a*.

The exhaust port 16 is configured to exhaust air in the casing 11 to the outside. The exhaust port 16 is arranged on the Z1 side.

The sealing member 17 is arranged on the lower side (Z2 side) of the exhaust port 16. The sealing member 17 is configured to be pushed upward by the liquid so as to seal the exhaust port 16 when liquid is drawn. The sealing member 17 has a spherical shape.

The base portion 18 is configured to receive the sealing member 17. The base portion 18 is formed on the bottom surface of the exhaust tube 19, which communicates with the pump chamber 1. The base portion 18 is configured to form an upward flow of liquid for pushing the sealing member 17 toward the exhaust port 16 when the liquid flows inward. The base portion 18 has a generally V shape that is formed by intersecting inclined parts. Liquid flows from an opening part of the base portion 18 toward the intersecting point so that the upward flow of liquid, which pushes the sealing member 17 upward, is produced by the intersecting point.

The exhaust tube 19 has a cylindrical shape. A cut-out part that communicates with the casing 11 is formed on the Z2 side of the exhaust tube 19. Air in the casing 11 can be exhausted through exhaust tube 19 from the exhaust port 16. When liquid flows into the casing 11 and the casing 11 becomes filled with the liquid, the liquid also flows into the exhaust tube 19 so that the base portion 18 will produce a flow that pushes the sealing member 17 upward (moves the sealing member 17 in the Z1 direction). As a result, the exhaust port 16 is sealed by the sealing member 17 pushed upward.

Effect of the Invention

In this embodiment, the following advantages are obtained.

In this embodiment, as discussed above, the casing 11 includes the suction flow-path portion 14, which faces the closed impeller 4, has the suction port 12 protruding in a convex shape and is formed integrally with the casing 11. Accordingly, even if the depth of the casing 11 is increased in order to increase the flow rate, the gap G between the closed impeller 4 and the suction port 12 can be kept small by adjusting a protrusion height H of the suction flow-path portion 14. Consequently, the gap between the closed impeller 4 and the suction port 12 can be kept small so that a flow rate of liquid that laterally flows through the gap between the suction port 12 and the closed impeller 4 can be minimized while increasing the depth of the casing 11 whereby increasing the flow rate. Also, the size of the gap G between the closed impeller 4 and the suction port 12 can be adjusted by the protrusion height H of the suction flow-path portion 14, and thus the vane width W can be small. Consequently, the vane width W can be small, and thus entry of liquid to the electric motor 3 side that is caused by shaft distortion can be reduced. Therefore, the flow rate can be increased while reducing entry of liquid to the electric motor 3 side.

In this embodiment, as discussed above, the vane width W as a height of the closed impeller 4, which includes the vane portion 41 and the main and side plates 42 and 43, in the main shaft 33 extension direction is smaller by the protrusion height H of the suction flow-path portion 14 in the main shaft 33 extension direction than the maximum depth D of the flow path 15 of the casing 11 in the main shaft 33 extension direction. Accordingly, the vane width W of the closed impeller 4 can be reduced by the protrusion height H of the suction flow-path portion 14, and thus the vane width W can be easily reduced. As a result, distortion of the main shaft 33 caused by such a vane width W increase can be reduced, and therefore entry of liquid to the electric motor 3 side can be easily prevented.

In this embodiment, as discussed above, the suction flow-path portion 14 has a cylindrical shape extending from the suction port 12 side toward the closed impeller 4 side. Accordingly, liquid can be drawn through the cylindrical inside flow path of the suction flow-path portion 14.

In this embodiment, as discussed above, the side plate 43 of the closed impeller 4 has an opening 43*a* opened on the suction flow-path portion 14 side; and the inside diameter r1 of the opening 43*a* is substantially the same as the inside diameter r2 of the suction flow-path portion 14 on an end of the closed impeller 4 side as viewed in the extension direction of the main shaft 33. Accordingly, a flow path that connects the suction flow-path portion 14 to the closed impeller 4 can have substantially a constant diameter, and thus the closed impeller 4 can efficiently draw liquid that passes through the suction flow-path portion 14.

In this embodiment, as discussed above, the casing 11 and the suction flow-path portion 14 are integrally formed of a resin. Accordingly, the casing 11 having the suction flow-path portion 14 can be easily formed.

In this embodiment, as discussed above, the side plate 43 of the closed impeller 4 has an opening 43*a* opened on the suction flow-path portion 14 side; and the opening 43*a* and the suction flow-path portion 14 are spaced at an interval not greater than 5 mm from each other in the extension direction of the main shaft 33. Accordingly, a flow rate of liquid that laterally flows through the gap between the opening 43*a* and the suction flow-path portion 14 can be minimized, and thus it is possible to prevent efficiency reduction of the electric submersible pump 100.

In this embodiment, as discussed above, the protrusion height H of the suction flow-path portion 14 in the extension direction of the main shaft 33 is not smaller than 20% of the maximum depth D of the flow path 15 in the extension direction of the main shaft 33. Accordingly, it is possible to produce the electric submersible pump 100 having a sufficient flow rate while preventing an increase of the vane width W of the closed impeller 4. The present inventor confirms this effect on the basis of the later-discussed experiment (examples).

In this embodiment, as discussed above, the casing 11 includes the exhaust port 16 for exhausting air in the casing 11, the sealing member 17 arranged below the exhaust port 16 and configured to be pushed upward by liquid so as to seal the exhaust port 16 when the liquid is drawn, and the base portion 18 configured to receive the sealing member 17 and to form an upward flow of liquid for pushing the sealing member 17 toward the exhaust port 16. Accordingly, the base portion 18 is positioned in the vicinity below the center of gravity of the sealing member 17 so that the sealing member 17 can be stably pushed upward, and thus the sealing member 17 can be reliably pushed to the position of the exhaust port 16 whereby reliably sealing the exhaust port 16.

In this embodiment, as discussed above, the base portion 18 has a generally V shape. Accordingly, inclined parts, which form the V shape, can collect liquid, and thus an upward force for pushing the sealing member 17 can be increased.

Examples

Figure 8:
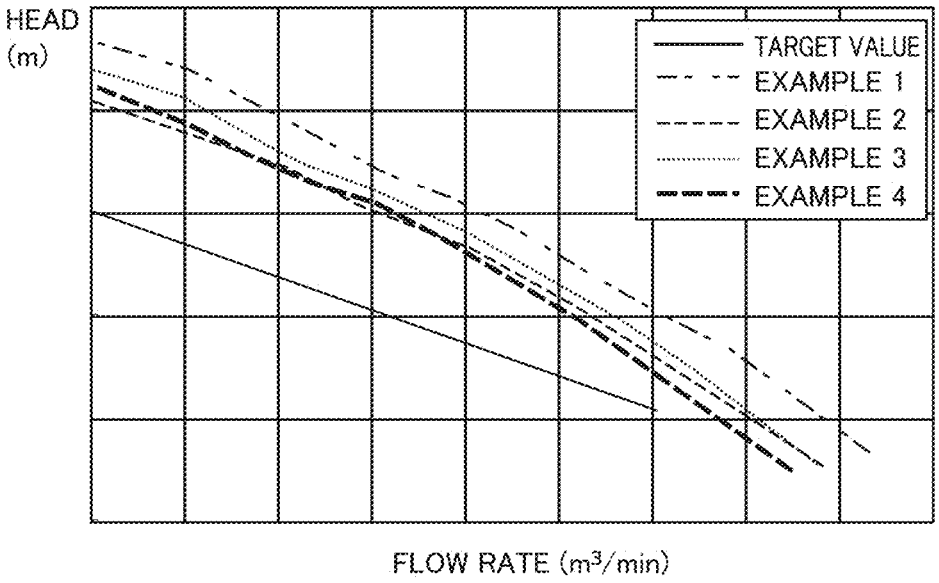
FIG. 8 is a graph showing relations between head and flow rate.

The inventor examined relations between flow rate ($m^3$/min) and head (m) of electric submersible pumps 100, which have different ratios of the protrusion height H of their suction flow-path portion 14 to the maximum depth D of their flow path 15 in the main shaft 33 extension direction. A preferred relation between head and flow rate is additionally shown as target values corresponding to a case of a saleable product of the electric submersible pump 100 having a sufficient flow rate to compare measurement results with target values. Specifically, the inventor produced an example 1 corresponding to 18.3% (a ratio of the vane width W to the maximum depth D of the flow path 15 is 73.8%), an example 2 corresponding to 23.2% (a ratio of the vane width W to the maximum depth D of the flow path 15 is 69.0%), an example 3 corresponding to 27.2% (a ratio of the vane width W to the maximum depth D of the flow path 15 is 65.0%) and an example 4 having a protrusion height H of the suction flow-path portion 14 corresponding to 32.1% of the maximum depth D of the flow path 15 (a ratio of the vane width W to the maximum depth D of the flow path 15 is 60.0%), and measured flow rates ($m^3$/min) and heads (m). The heads (m) and the flow rates ($m^3$/min) are plotted in FIG. 8 with the vertical and horizontal axes indicating the heads and the flow rates, respectively. The inventor finds that the flow rates in all examples can be increased greater than the limit of a flow rate that can be increased in accordance with the target values (the end of a line of the target values in the graph) on the basis of the results of this experiment. In addition, the inventor finds that even in a case in which a protrusion height H of the suction flow-path portion 14 is not smaller than 18% of the maximum depth D the electric submersible pump 100 having a sufficient flow rate can be produced.

Figure 9:
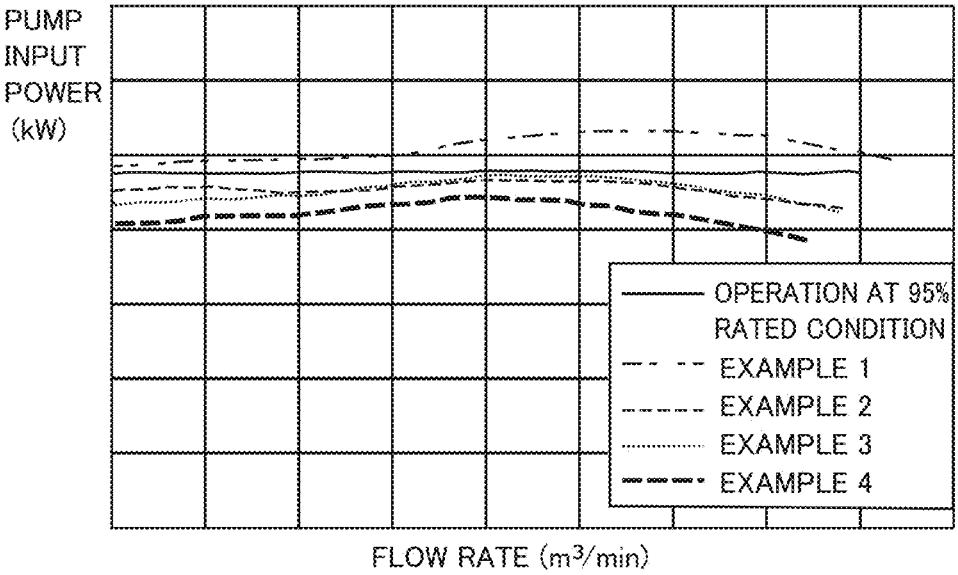
FIG. 9 is a graph showing relations between pump input power and flow rate.

The inventor examined relations between flow rate ($m^3$/min) and pump input power (kW) of electric submersible pumps 100, which have different ratios of the protrusion height H of their suction flow-path portion 14 to the maximum depth D of their flow path 15 in the main shaft 33 extension direction. Specifically, the inventor measured flow rates ($m^3$/min) and pump input powers (kW) in the foregoing examples 1, 2, 3 and 4. In addition, the inventor measured flow rates ($m^3$/min) and pump input powers (kW) of an electric submersible pump operating at 95% of its rated condition. The pump input powers (kW) and the flow rates ($m^3$/min) are plotted in FIG. 9 with the vertical and horizontal axes indicating the pump input powers and the flow rates, respectively. On the basis of FIG. 9, the present inventor find that the flow rate of the electric submersible pump 100 according to the present invention having the suction flow-path portion 14 can be increased to a sufficient flow rate similar to the electric submersible pump operating at 95% of its rated condition.

Figure 10:
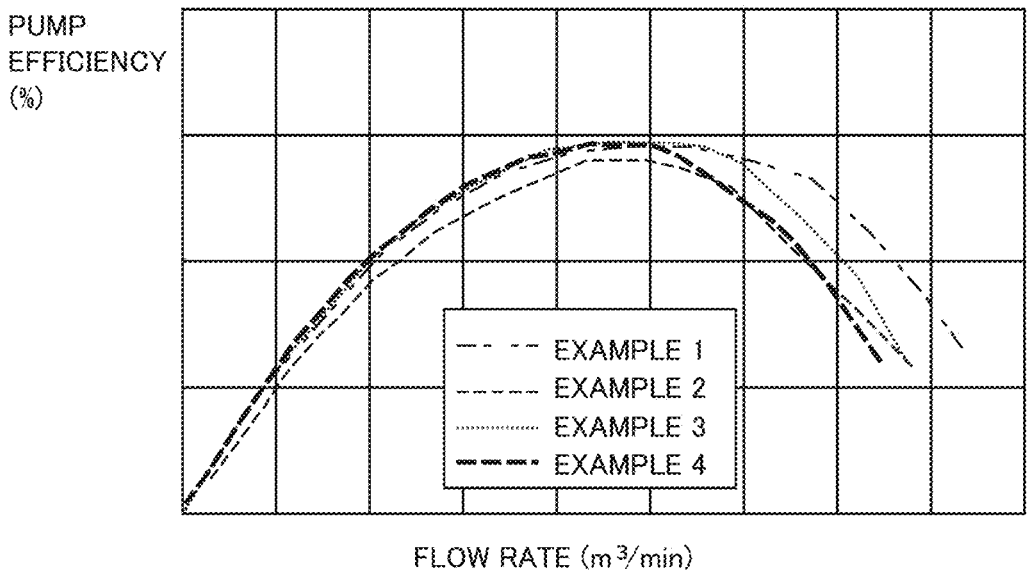
FIG. 10 is a graph showing relations between pump efficiency and flow rate.

The inventor examined relations between flow rate ($m^3$/min) and pump efficiency (%) of electric submersible pumps 100, which have different ratios of the protrusion height H of their suction flow-path portion 14 to the maximum depth D of their flow path 15 in the main shaft 33 extension direction. Specifically, the inventor measured flow rates ($m^3$/min) and pump efficiencies (%) in the foregoing examples 1, 2, 3 and 4. The pump efficiencies (%) and the flow rates ($m^3$/min) are plotted in FIG. 10 with the vertical and horizontal axes indicating the pump efficiencies and the flow rates, respectively. On the basis of FIG. 10, the present inventor find that certain pump efficiencies can be obtained even in a case in which the flow rate is large.

On the basis of these results, the present inventor find that, even in a case in which the vane width W is kept small from the viewpoint of distortion reduction, the flow rate can be sufficiently increased while keeping certain pump efficiencies under certain limit of pump input power by adjustment of the protrusion height H of the suction flow-path portion 14. In addition, the electric submersible pump 100 can be further optimized by proper adjustment of the outside diameter of the vane width.

Modified Embodiments

Note that the embodiment disclosed this time must be considered as illustrative in all points and not restrictive. The scope of the present invention is not shown by the above description of the embodiment but by the scope of claims for patent, and all modifications (modified embodiments) within the meaning and scope equivalent to the scope of claims for patent are further included.

For example, while the example in which the suction flow-path portion has a cylindrical shape has been shown in the aforementioned embodiment, the present invention is not limited to this. In the present invention, the suction flow-path portion may have a rectangular parallelepiped, for example.

While the example in which an inside diameter of the opening is substantially the same as an inside diameter of the suction flow-path portion on an end of the closed impeller side as viewed in the extension direction of the main shaft has been shown in the aforementioned embodiment, the present invention is not limited to this.

In the present invention, the inside diameter of the opening may be different from the inside diameter of the suction flow-path portion on the end of the closed impeller side as viewed in the extension direction of the main shaft.

While the example in which the casing and the suction flow-path portion are integrally formed of a resin has been shown in the aforementioned embodiment, the present invention is not limited to this. In the present invention, the casing and the suction flow-path portion may be integrally formed of a metal.

While the example in which the base portion has a generally V shape has been shown in the aforementioned embodiment, the present invention is not limited to this. In the present invention, the base portion has a generally U shape, for example.

While the example in which the lower and upper casings are separately produced has been shown in the aforementioned embodiment, the present invention is not limited to this. In the present invention, the lower and upper casings may be integrally produced.

The invention claimed is:

1. An electric submersible pump comprising:

a casing (11) including a flow path (15) having a spiral shape, and a suction port (12) for drawing liquid into the flow path;

a closed impeller (4) including a vane portion (41), a main plate (42) holding the vane portion, and a side plate (43) opened on the suction port side of the casing; and an electric motor (3) including a main shaft connected to the closed impeller, wherein the casing includes a suction flow-path portion (14) that faces the closed impeller, has the suction port protruding in a convex shape and is formed integrally with the casing; and a sum of a vane width and a protrusion height of the suction flow-path portion in the extension direction of the main shaft is smaller than a depth of the flow path between a topmost inner surface of the casing and a bottommost inner surface of the casing in an extension direction of the main shaft, the vane width is a height of the closed impeller including the vane portion, the main plate and the side plate in the extension direction of the main shaft, and the protrusion height of the suction flow-path portion in the extension direction of the main shaft is not smaller than 15% of a maximum depth of the flow path in the extension direction of the main shaft.

2. The electric submersible pump according to claim 1, wherein the suction flow-path portion has a cylindrical shape extending from the suction port side toward the closed impeller side.

3. The electric submersible pump according to claim 2, wherein the side plate of the closed impeller has an opening opened on the suction flow-path portion side; and an inside diameter of the opening is substantially the same as an inside diameter of the suction flow-path portion on an end of the closed impeller side as viewed in the extension direction of the main shaft.

4. The electric submersible pump according to claim 1, wherein the casing and the suction flow-path portion are integrally formed of a resin.

5. The electric submersible pump according to claim 1, wherein the side plate of the closed impeller has an opening opened on the suction flow-path portion side; and the opening and the suction flow-path portion are spaced at an interval greater than 0 mm and not greater than 5 mm from each other in the extension direction of the main shaft.

6. The electric submersible pump according to claim 1, wherein the protrusion height of the suction flow-path portion in the extension direction of the main shaft is not smaller than 20% of the maximum depth of the flow path in the extension direction of the main shaft.

7. The electric submersible pump according to claim 1, wherein the casing includes an exhaust port (16) for exhausting air in the casing, a sealing member (17) arranged below the exhaust port and configured to be pushed upward by the liquid so as to seal the exhaust port when the liquid is drawn, and a base portion (18) configured to receive the sealing member and to form an upward flow of the liquid for pushing the sealing member toward the exhaust port.

8. The electric submersible pump according to claim 7, wherein the base portion has a generally V shape.

* * * * *